US008128053B2

(12) United States Patent
Etzkorn

(10) Patent No.: US 8,128,053 B2
(45) Date of Patent: Mar. 6, 2012

(54) VERTICALLY ADJUSTABLE FURNITURE ITEM

(75) Inventor: Matthias Etzkorn, Lehmen (DE)

(73) Assignee: Stabilus GmbH, Koblenz (DE)

( * ) Notice: Subject to any disclaimer, the term of this patent is extended or adjusted under 35 U.S.C. 154(b) by 369 days.

(21) Appl. No.: 12/561,368

(22) Filed: Sep. 17, 2009

(65) Prior Publication Data

US 2010/0065711 A1 Mar. 18, 2010

(30) Foreign Application Priority Data

Sep. 17, 2008 (DE) ..... 10 2008 047 745

(51) Int. Cl.
*F16M 13/00* (2006.01)

(52) U.S. Cl. ..... 248/550; 248/404; 248/415

(58) Field of Classification Search ..... 248/550, 248/132, 161, 404, 415, 157, 137, 162.1
See application file for complete search history.

(56) References Cited

U.S. PATENT DOCUMENTS

| | | | | |
|---|---|---|---|---|
| 5,443,573 | A * | 8/1995 | Thiele et al. | 267/64.12 |
| 5,806,828 | A * | 9/1998 | Rothe et al. | 248/631 |
| 5,944,290 | A * | 8/1999 | Fuhrmann et al. | 248/161 |
| 7,134,634 | B2 * | 11/2006 | Jeon et al. | 248/161 |
| 7,306,192 | B2 * | 12/2007 | Sopp | 248/404 |
| 7,328,875 | B2 * | 2/2008 | Kastner et al. | 248/161 |
| 2006/0278805 | A1 * | 12/2006 | Haller | 248/588 |
| 2008/0015753 | A1 * | 1/2008 | Wereley et al. | 701/45 |

* cited by examiner

*Primary Examiner* — Ramon Ramirez
(74) *Attorney, Agent, or Firm* — Cozen O'Connor

(57) ABSTRACT

A vertically adjustable item of furniture with a vertical pipe, a supporting base arranged at a first end of the vertical pipe, a guide bush fastened to a second end of the vertical pipe opposite to the supporting base, a cylinder which is arranged coaxially in the vertical pipe a piston which divides the cylinder into a first work chamber and a second work chamber, a piston rod fastened by its first end to the piston extends through the second work chamber and a connection between the first work chamber and the second work chamber which can be blocked by a valve actuatable by an actuating device. The valve is controllable electromagnetically. The furniture item comprises a sensor or switch which generates a signal causing the valve to close when the piston reaches a position in the cylinder near the valve.

20 Claims, 6 Drawing Sheets

VERTICALLY ADJUSTABLE FURNITURE ITEM

BACKGROUND OF THE INVENTION

1. Field of the Invention

The invention is directed to a vertically adjustable item of furniture with a vertical pipe, a support base arranged at a first end of the vertical pipe, a guide bushing fastened to a second end of the vertical pipe opposite to the supporting base, and a cylinder arranged coaxially in the vertical pipe and filled with a compressed gas. A piston, guided in a guide pipe, divides the cylinder into a first work chamber and a second work chamber. A piston rod which is fastened by its first end to the piston and which extends through the second work chamber, is guided outward so as to be sealed by a sealing and guiding device and is arranged with its second end at the supporting base of the vertical pipe. There is a connection between the first work chamber and the second work chamber which can be blocked by a valve that can be actuated by an actuating device, wherein the cylinder is displaceably guided in the vertical pipe and projects out of the vertical pipe, and an object to which force can be applied can be arranged at the end of the cylinder projecting out of the vertical pipe.

2. Description of the Related Art

In furniture items of the type mentioned above, it is known to move the outwardly extended piston rod into the cylinder and, accordingly, to move the cylinder into the vertical pipe through the application of force when the manually controllable valve is open or to let the piston rod move outward by opening the manually controllable valve when releasing the furniture item so as to allow the cylinder to move out of the vertical pipe.

When the cylinder is slid into the vertical pipe, the sliding in movement is cushioned by a rubber buffer in the final move-in zone of the cylinder. However, depending on the release of the pressure present in the cylinder or the weight of a person sitting on a chair, this cushioning is not always carried out in a sufficiently comfortable manner.

SUMMARY OF THE INVENTION

An object of the invention to provide a furniture item of the type mentioned above in which the operating comfort and sitting comfort are improved.

This object is met according to one embodiment of the invention in that an electromagnetically controllable valve is utilized and the furniture item comprises a sensor or switch that generates a signal that causes the electromagnetically controllable valve to close when the piston has reached a position in the cylinder that is near the valve ensuring that the cylinder cannot move against the supporting base when the cylinder moves into the vertical pipe.

According to one embodiment of the invention, the sensor is arranged in the sealing and guiding device.

Alternatively, the sensor is arranged in a front wall opposite the sealing and guiding device.

The sensor is preferably a photosensor, an ultrasonic sensor, an inductive sensor, a capacitive sensor, or a Hall sensor, and the switch can be a reed contact, a microswitch, or the like. However, it is conceivable to use other types of sensors or switches.

The sensor detects a determined distance of the piston from the front wall or from the sealing and guiding device and sends a signal to a control unit when the piston rod is moved with the piston in direction of the front wall, and the control unit breaks the circuit of the coil so that an armature with a closing member closes the connection between the first work chamber and the second work chamber, even when a user actuates the actuating device.

Alternatively, the sensor detects a determined distance between a vertically adjustable component and the front side of the vertical pipe or a structural component part associated with the structural component part that is not vertically adjustable and sends a signal to the control unit when a vertically adjustable component is moved in direction of the front side of the vertical pipe, and the control unit breaks the circuit of the coil so that the armature and the closing member closes the connection between the first work chamber and the second work chamber, even when a user actuates the actuating device.

In one embodiment, the front wall closing the top end of the guide pipe has a first portion and a second portion, the two portions are held at a distance from one another by two connection webs, the connection webs are integrally connected with the two portions.

In so doing, an intermediate space is formed between the two portions, which are at a distance from one another, and at least one substantially C-shaped ferromagnetic plate is received in the intermediate space so that the plate is arranged in the intermediate space by a press fit.

According to one embodiment of the invention, at least one radial groove leads from the valve chamber to the annular gap at the side of the first portion opposite to the first work chamber so as to allow flow under the plate.

According to one embodiment of the invention, a tubular extension extends in direction of the end of the cylinder opposite to the sealing and guiding device from the side of the second portion opposite to the first portion.

In another construction, the armature is arranged at least partially in the extension, and the armature has at the side facing the connection the closing member that is made of an elastomer.

The armature has, at its side opposite to the valve chamber, a blind hole in which a spring element is arranged. The spring element acts upon the armature with preloading toward the valve seat.

When the valve passage between the surface of the armature, remote of the valve seat, and a front side of a core, extending into the extension from the upper side of the cylinder is closed, this results in a distance forming the actuating path.

In another construction, the second portion is sealed relative to the inner wall of the cylinder by a first sealing ring, the extension is sealed relative to the core by a second sealing ring, and the first portion is sealed relative to the inner wall of the guide pipe by a third sealing ring.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

DETAILED DESCRIPTION OF THE PRESENTLY PREFERRED EMBODIMENTS

Figure 1:
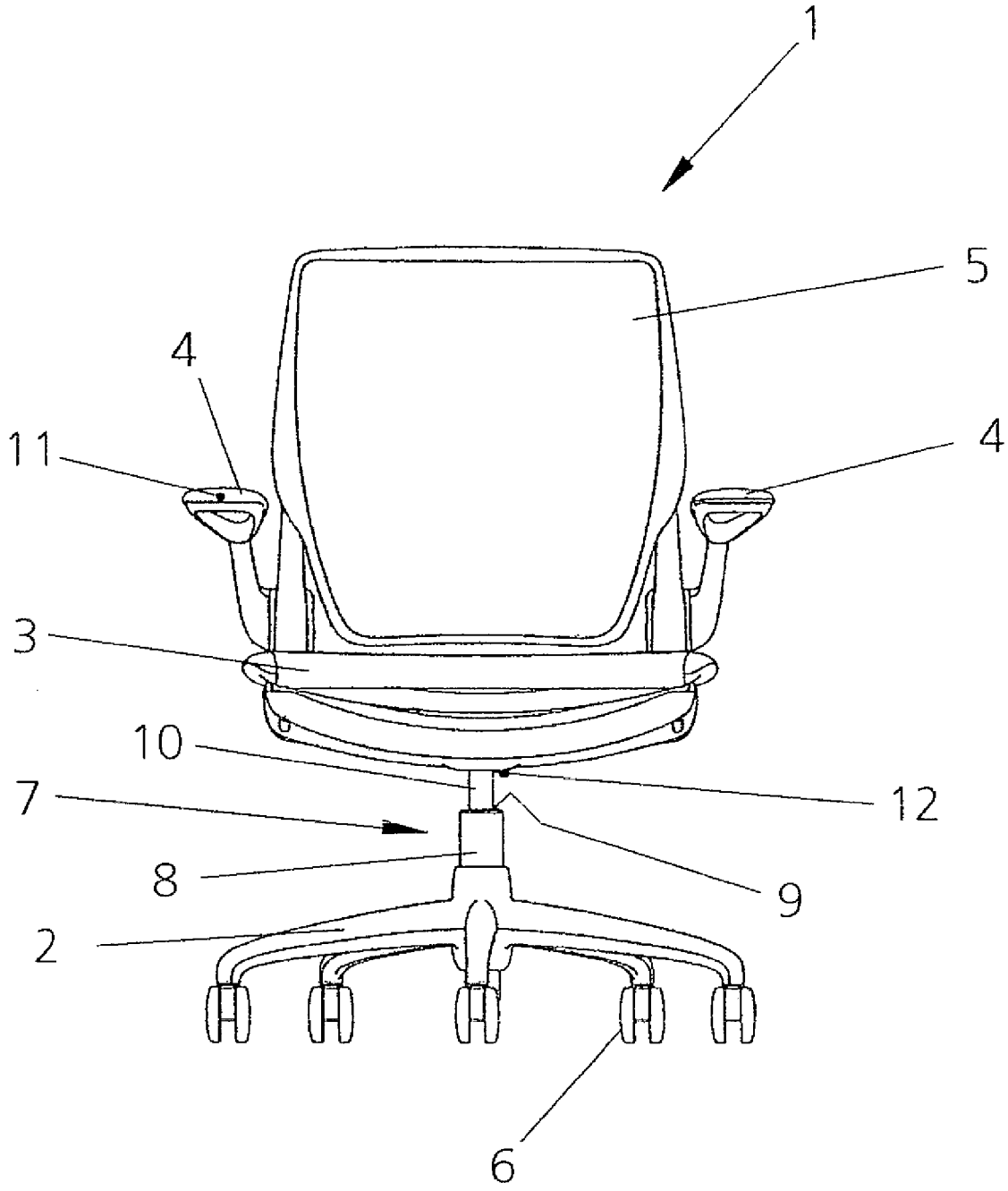
FIG. 1 is a front view of an office chair constructed according to the invention with an adjusting device.

FIG. 1 is an office chair 1 constructed as a swivel chair with a structural component part that is formed as a 5-point chair base 2, which is not vertically adjustable, and a vertically adjustable structural component part which is formed as a seat 3 with side armrests 4 and with a backrest 5. Rollers 6 are arranged at the 5-point chair base 2. The 5-point chair base 2 and seat 3 are connected to one another by an adjusting device 7 so as to be vertically adjustable and rotatable relative to one another. The adjusting device 7 comprises a vertical pipe 8, which has an end face 9 facing the seat 3 and a gas spring 10, which is guided concentrically in the vertical pipe 8. An actuating device 11 comprising one or more switches is integrated in the armrests 4 and can block or unblock the gas spring 10. There are also other suitable possibilities for the arrangement of the actuating device. For example, it can be arranged at the underside of the seat 3.

Further, a sensor 12 whose function will be explained in the following is located at the side of the seat 3 facing the 5-point chair base 2.

Figure 2:
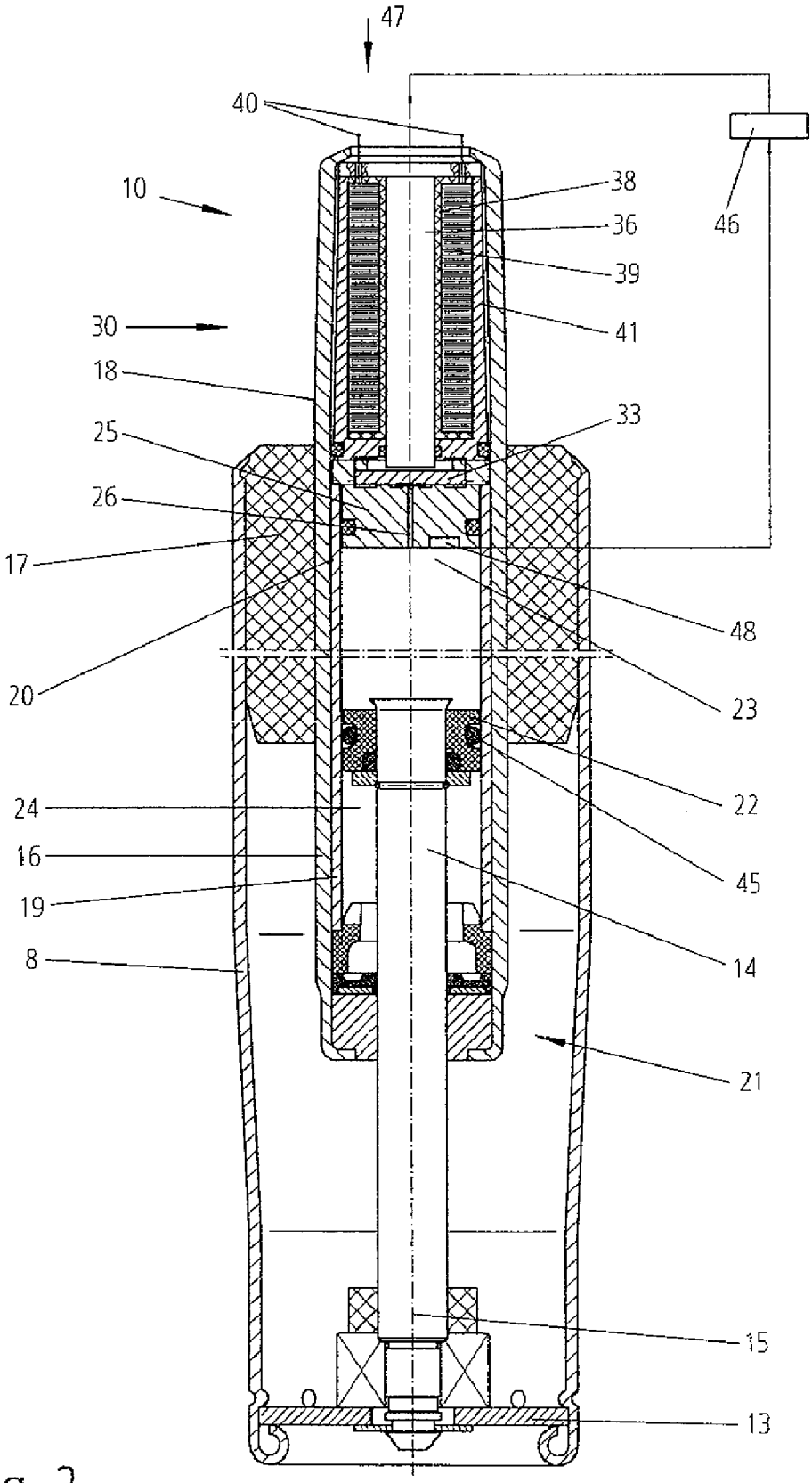
FIG. 2 is a cross-sectional view of a first embodiment form of the adjusting device.

As shown in FIG. 2, a supporting base 13 is fixedly inserted at the lower end of the vertical pipe 8, a first end of a piston rod 14 of the gas spring 10 is fastened to the supporting base 13 in an axially rotatable manner around its longitudinal axis 15. However, it is also possible to provide means for safeguarding against the rotation of the gas spring around its longitudinal axis.

Figure 3:
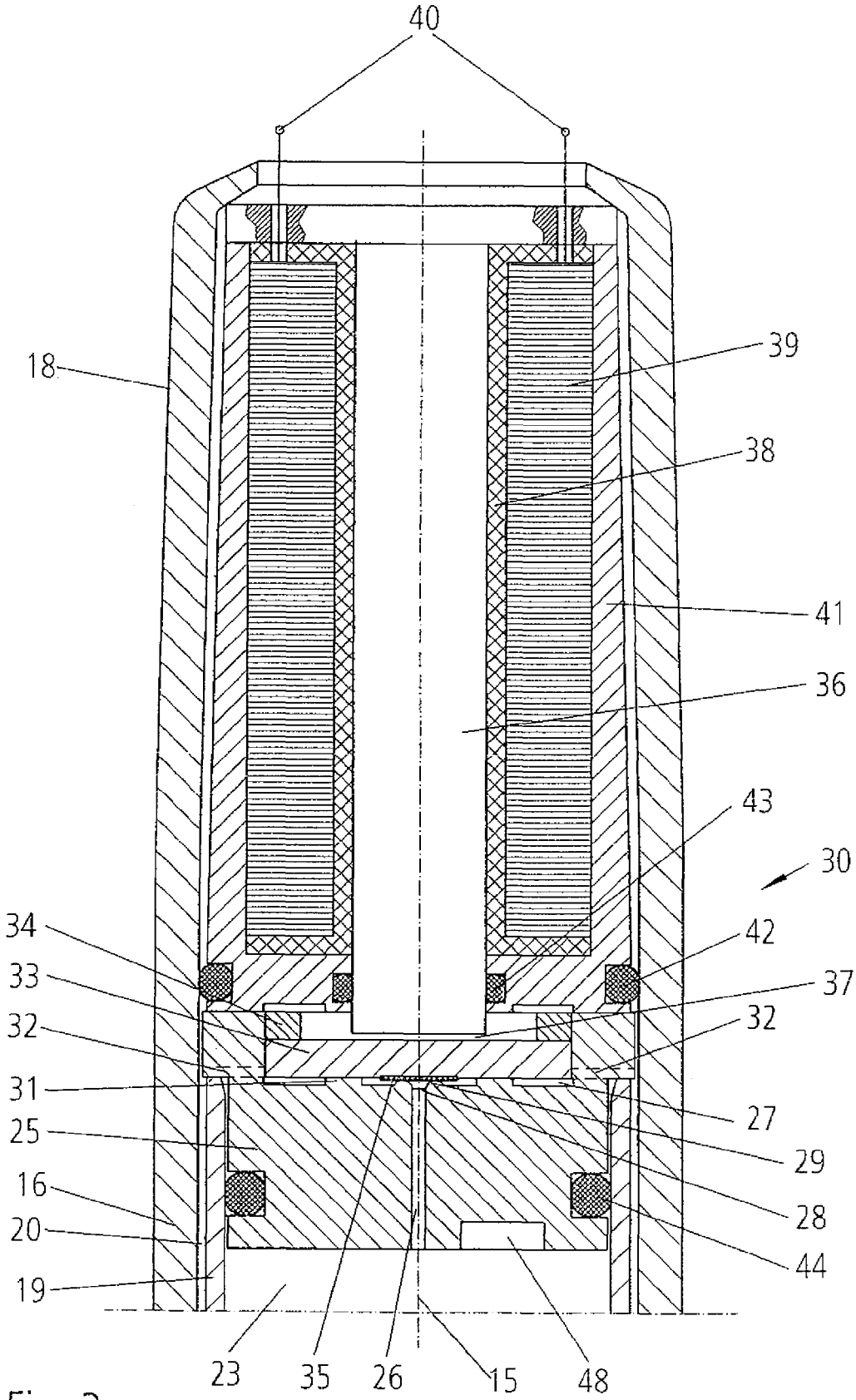
FIG. 3 is a cross-sectional view of an enlarged section of the upper area of the adjusting device according to FIG. 2.

As can be seen from FIG. 2 and FIG. 3, the gas spring 10 has a cylinder 16, which is guided to be axially displaceable in a guide bush 17, which is inserted into the upper end of the vertical pipe 8, the cylinder 16 projecting out of the upper end of the vertical pipe 8. In this case, by way of example, the end of the cylinder 16 projecting out of the vertical pipe 8 is formed as a cone 18 for receiving the seat 3.

A guide pipe 19, filled with a compressed gas, is fixedly arranged coaxially inside the cylinder 16 such that an annular gap 20 is formed between the cylinder 16 and the guide pipe 19.

The annular gap 20 is connected to the interior space of the guide pipe 19 at the end of the gas spring 10 on the exit side of the piston rod.

The piston rod 14 is guided into the cylinder 16 so as to be sealed by a sealing and guiding device 21. Piston rod 14 carries, at its end projecting into the guide pipe 19, a piston 22 which divides the interior space of the guide pipe 19 into a first work chamber 23 and a second work chamber 24 and which is guided in the guide pipe 19 so as to be displaceable.

As shown in FIG. 3, a front wall 25 closes the upper end of the guide pipe 19. A coaxially continuous connection 26 leading from the first work chamber 23 into a valve chamber 27 having a circular cross section is formed in the front wail 25. An axially projecting valve seat 29 of an electromagnetic valve 30 is formed at the orifice 28 into the valve chamber 27, this valve seat 29 surrounding the orifice 28 annularly.

The front wall 25 has an annular stop 31 which surrounds the valve seat 29 at a distance and which projects axially from the valve seat 29 in a corresponding manner.

Radial bore holes 32 lead from the valve chamber 27 to the annular gap 20.

A correspondingly circular armature 33 is guided in the valve chamber 27 so as to be axially displaceable. This armature 33 is preferably formed as a plate acted upon at its circumferential edge area by an axially supported ring-shaped spring element 34 with preloading against the valve seat 29 and the stop 31.

In the area of the valve seat 29, the armature 33 has a disk-shaped closing member 35 made of an elastomer, which closes the connection 26 when contacting the valve seat 29.

When the valve passage is closed, a distance forming an actuating path 37 is formed between the surface of the armature 33 remote of the valve seat 29 and a front side of a core 36.

The core 36 projects into an annular coil carrier 38 for a coil 39, both of whose ends 40 project axially out of the cylinder 16.

The cylinder 16 made from a ferromagnetic material surrounds the coil 39, the coil carrier 38 and a cup-shaped receiving part 41 for the coil 39 and coil carrier 38 by its area having the cone 18.

The receiving part 41 is sealed relative to the inner wall of the cylinder 16 by a first sealing ring 42 and relative to the cylindrical core 36 by a second sealing ring 43.

The front wall 25 is sealed relative to the inner wall of the guide pipe 19 by a third sealing ring 44, and the piston 22 is sealed relative to the inner wall of the guide pipe 19 by a fourth sealing ring 45.

Actuating the actuating device 11 by a control unit 46 energizes the coil 39. By energizing the coil 39, the armature 33 with the closing member 35 is lifted from the valve seat 29 against the force of the spring element 34 so that the first work chamber 23 is connected to the second work chamber 24 by the connection 26, the valve chamber 27, the radial bore holes 32 and the annular gap 20.

When the gas spring 10 is loaded in the direction indicated by arrow 47, the piston 22 and the piston rod 14 move into the guide pipe 19, and the gas spring 10 moves into the vertical pipe 8. By cutting off power to the coil 39, the electromagnetic valve 30 closes and the seat 3 is adjusted to the desired height.

In order to move the seat 3 into the maximum extended position again, the seat 3 and, therefore, the gas spring 10 need only be released and the electromagnetic valve 30 opened manually. Due to working surfaces of different size on both sides of the piston 22 and identical pressure ratios in the first work chamber 23 and second work chamber 24, the piston 22 and piston rod 14 move outward so that the gas spring 10 is moved out of the vertical pipe 8.

Also arranged in the front wall 25 is a sensor 48 that detects the distance of the piston 22 from the front wall 25 and sends a corresponding signal to the control unit 46.

If the sensor 48 has detected a certain distance of the piston 22 from the front wall 25 when the seat 3 is moved from a higher position into a lower position, it generates a signal and sends this signal to the control unit 46 which in turn breaks the circuit of the coil 39 so that the armature 33 with the closing member 35 closes the connection 26 even when the user actuates the actuating device 11.

The electromagnetic valve 30 closes when the piston 22 has reached a distance of about 3 to 10 cm from the sealing and guiding device 21. The adjustment of the distance can be programmed into a memory included in the control device 46.

In so doing, the travel of the gas spring, the pressure contained in the gas spring, and/or the weight loading the furniture item can also be taken into account. This can also be determined by means of the sensor 48 or by means of an additional sensor.

Figure 4A:
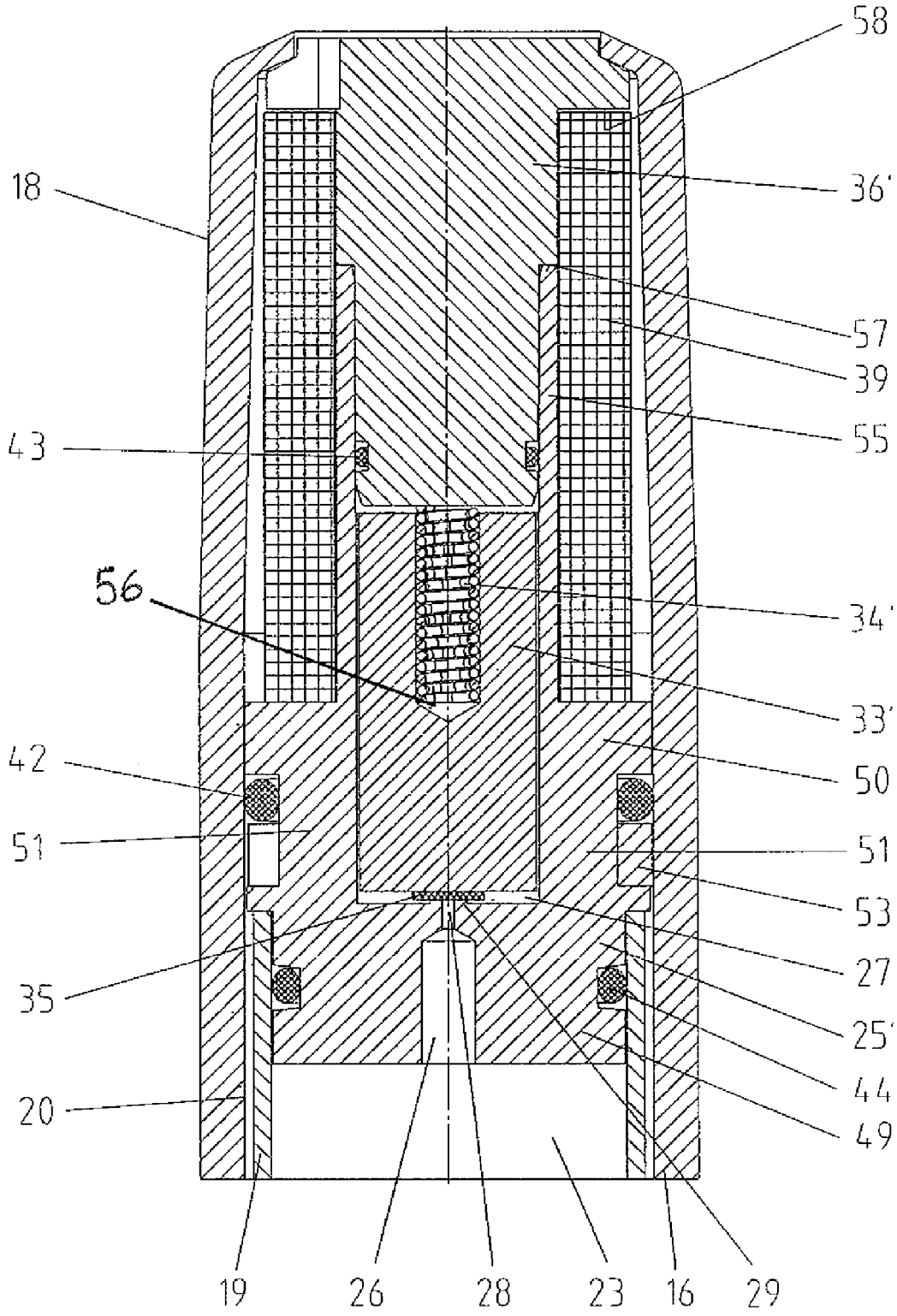
FIG. 4*a* is a cross-sectional view of an enlarged section of the upper area of a second embodiment form of the adjusting device.
Figure 4B:
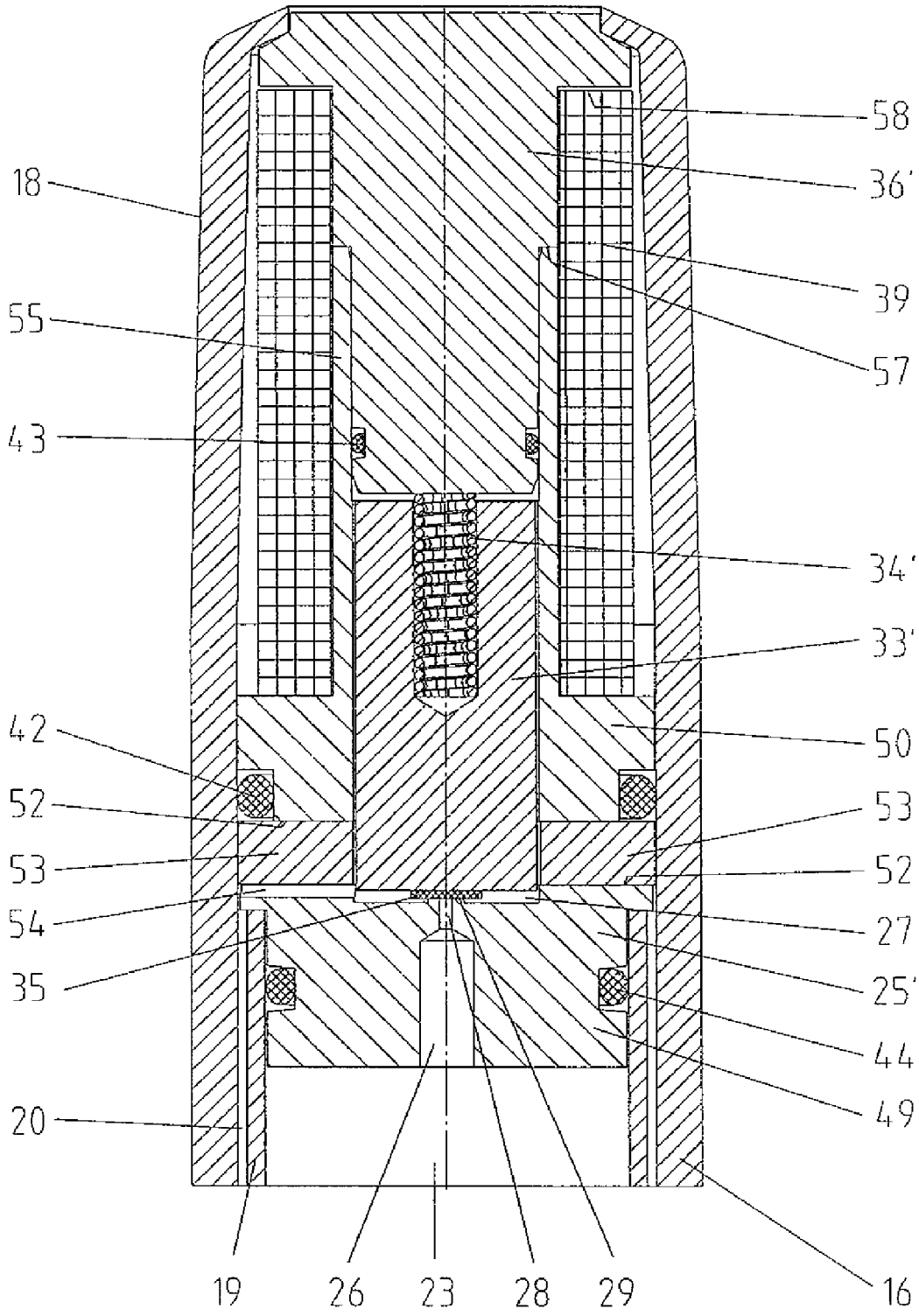
FIG. 4*b* is another cross-sectional view of the second embodiment form of the adjusting device according to FIG. 4*a*.

FIGS. 4*a* and 4*b* show another embodiment example of the upper part of the gas spring 10. Identically designed structural component parts are provided with the same reference numbers as the structural component parts shown in FIGS. 1 to 3 and 5. A prime symbol is added to the reference numbers of structural component parts whose construction is altered but which have the same function.

The upper end of the guide pipe 19 is closed by the front wall 25'. The front wall 25' comprises a first portion 49 and a second portion 50. Two connection webs 51 hold the two portions 49 and 50 at a distance from one another. The connection webs are integrally connected with the two portions 49 and 50.

As shown in FIG. 4*b* an intermediate space 52 is formed between the two portions 49 and 50, which are at a distance from one another. At least one substantially C-shaped ferromagnetic plate 53 can be received in this intermediate space 52. The plate 53 is arranged in the intermediate space 52 by a press fit for improved mounting. A plurality of arch-shaped plates can also substitute for the plate 53.

The coaxially continuous connection 26 leading from the first work chamber 23 into the valve chamber 27 is formed in the front wall 25'. The axially projecting valve seat 29 of the electromagnetic valve 30 is formed at the orifice 28 into the valve chamber 27, this valve seat 29 surrounding the orifice 28 annularly.

At least one radial groove 54 leads from the valve chamber 27 to the annular gap 20 at the side of the first portion 49 opposite to the first work chamber 23 so as to allow flow under the plates 53.

A tubular extension 55 extends in direction of the upper end of the gas spring 10 from the side of the second portion 50 opposite to the first portion 49. The diameter of the valve chamber 27 and the diameter of the extension 55 are identical so that a cylindrical armature 33' can be arranged to extend into the extension 55. At the side facing the connection 26, the armature 33' has the closing member 35 which is preferably made of an elastomer and through which the connection 26 is closed when contacting the valve seat 29.

At its side opposite to the valve chamber 27, the armature 33' has a blind hole 56 in which is arranged a spring element 34' that acts upon the armature 33' with preloading toward the valve seat 29.

When the valve passage is closed, a distance forming the actuating path 37 is formed between the surface of the armature 33' remote of the valve seat 29 and a front side of the core 36' which extends into the extension 55 from the top of the gas spring 10. The core 36' is substantially cylindrical and in one embodiment, has portions with different diameters so as to form two steps 57 and 58 by which it is supported in downward direction against the extension 55 and/or against the coil 39.

The first portion 49 is sealed relative to the inner wall of the guide pipe 19 by the third sealing ring 44, the second portion 50 is sealed relative to the inner wall of the cylinder 16 by the first sealing ring 42, and the extension 55 is sealed relative to the cylindrical core 36 by the second sealing ring 43.

As is shown in FIG. 3, the two ends of the coil are guided out of the cylinder. However, it is also conceivable to arrange a plug connector, not shown, at the end of the cylinder 16. The ends of the coil are connected to the plug connector on one side, and a plug element, which is connected to the control unit 46 or to an energy source by lines can be connected to the plug connector on the other side.

Figure 5:
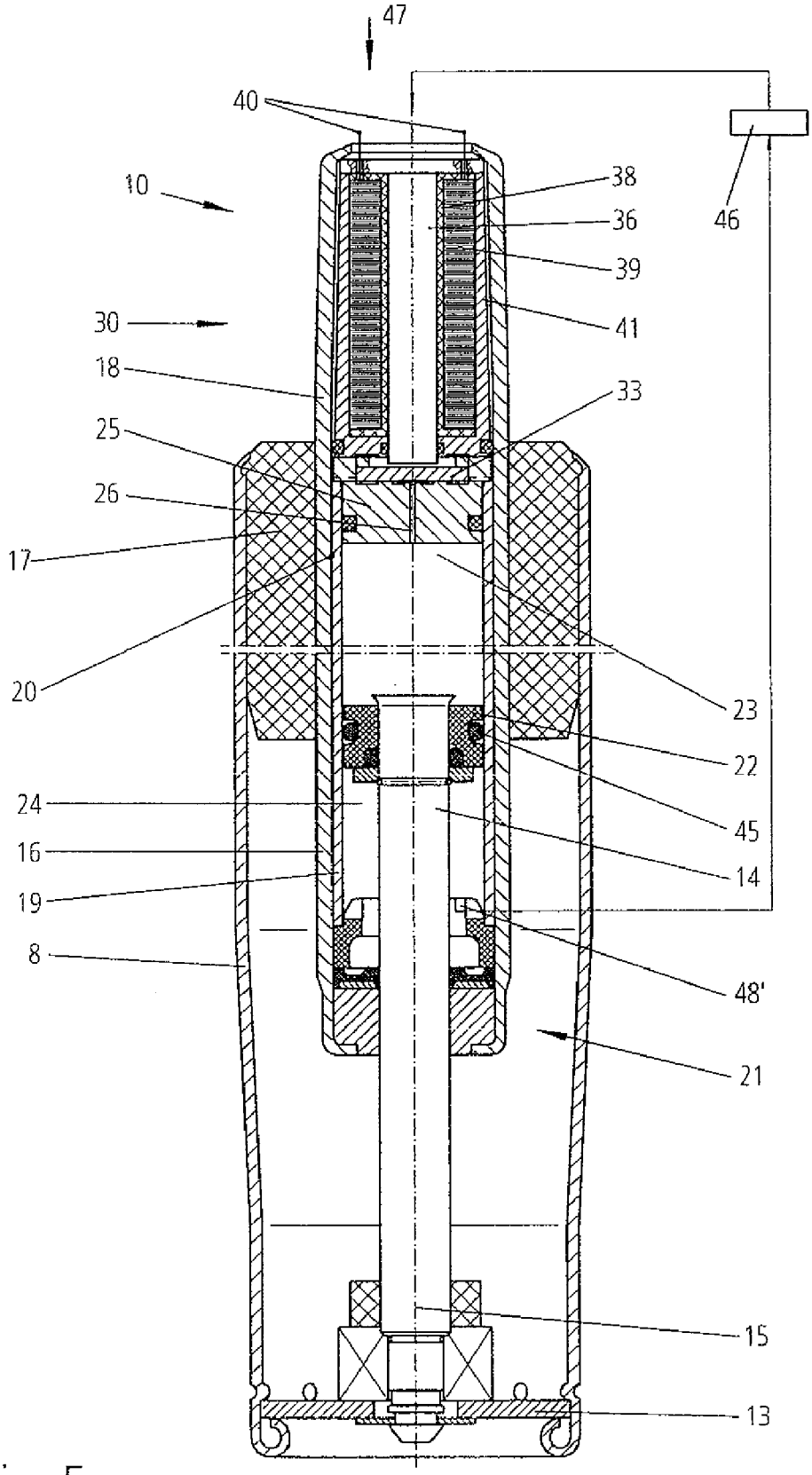
FIG. 5 is a cross-sectional view of a third embodiment form of the adjusting device.

The construction of the adjusting device 7 shown in FIG. 5 substantially corresponds to the construction of the embodiment form shown in FIG. 2. However, the sensor installed in the sealing and guiding device 21 is sensor 48' which detects the distance of the piston 22 from the sealing and guiding device 21. If the sensor 48'detects a determined distance between the piston 22 from the sealing and guiding device 21, preferably when the height of the seat is lowered, it generates a signal and sends this signal to the control unit 46. The circuit of the coil 39 is broken and the armature 33 closes the connection 26 with the closing member 35 even when the user actuates the actuating device 11.

The sensor 12 shown in FIG. 1 carries out the same function. This sensor 12 is arranged at a structural component part associated with the seat 3 and detects either the distance to the end face 9 of the vertical pipe 8 or a structural component part associated with the 5-point chair base 2 so that the circuit of the coil 39 is again broken by the control unit 46, and the armature 33 closes the connection 26 with the closing member 35, and the second work chamber 24 is sufficiently dimensioned to have a comfortable cushioning at the position of the piston 22 corresponding to the lowest adjustable position of the seat 3.

The sensors can include all suitable types of sensor, for example, ultrasonic sensors or Hall sensors, capacitive sensors or inductive sensors, photosensitive sensors or the like. Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

I claim:

1. A vertically adjustable item of furniture comprising:

a supporting base;

a vertical pipe having a first end arranged at the supporting base;

a guide bush fastened to a second end of the vertical pipe opposite the supporting base;

a cylinder coaxially arranged in the vertical pipe, the cylinder being filled with a compressed gas, wherein the cylinder is displaceably guided in the vertical pipe and projects out of the vertical pipe;

a piston arranged in a guide pipe, the piston dividing the cylinder into a first work chamber and a second work chamber;

a piston rod fastened at a first end to the piston, the piston rod configured to extend through the second work chamber and is sealingly guided outward by a sealing and guiding device, a second end of the piston rod arranged with its second end at the first end of the vertical pipe;

an electromagnetically controllable valve arranged in a valve chamber and configured to block a connection between the first work chamber and the second work chamber, the valve configured to be actuated by an actuating device;

an object to which force can be applied arranged at the end of the cylinder projecting out of the vertical pipe; and at least one of a sensor and a switch configured to generate a signal that causes the electromagnetically controllable valve to close when the piston reaches a predetermined position in the cylinder.

2. The furniture item according to claim 1, wherein the at least one of the sensor and the switch is arranged in the sealing and guiding device.

3. The furniture item according to claim 1, wherein the at least one of the sensor and the switch is arranged in a front wall opposite to the sealing and guiding device.

4. The furniture item according to claim 3, wherein the at least one of the sensor and the switch is configured to:

detect a determined distance of the piston from at least one of the front wall or from the sealing and guiding device; and send a signal to a control unit when the piston rod is moved with the piston in direction of the front wall, wherein the control unit breaks a coil circuit so that an armature with a closing member closes the valve connection between the first work chamber and the second work chamber, even when a user actuates the actuating device.

5. The furniture item according to claim 3, wherein an upper end of the guide pipe is closed by the front wall, the front wall having a first portion and a second portion, wherein the first and the second portions are held at a distance from one another by a connection web, the connection web being integrally connected with the first and the second portions.

6. The furniture item according to claim 5, wherein an intermediate space is formed between the first and the second portions and at least one substantially C-shaped ferromagnetic plate is received in the intermediate space in a press fitting manner.

7. The furniture item according to claim 6, wherein at least one radial groove leads from the valve chamber to an annular gap at the side of the first portion opposite to the first work chamber to allow flow under the plate.

8. The furniture item according to claim 5, further comprising a tubular extension that extends in a direction of the end of the cylinder opposite to the sealing and guiding device from the side of the second portion opposite to the first portion.

9. The furniture item according to claim 8, wherein the armature is arranged at least partially in the extension and the armature has, at a side facing the connection, a closing member being made of an elastomer.

10. The furniture item according to claim 9, wherein the armature comprises at its side opposite to the valve chamber a blind hole, a spring arranged in the blind hole, the spring configured to act upon the armature with preloading toward a valve seat.

11. The furniture item according to claim 10, wherein when a valve passage between the surface of the armature remote of the valve seat and a side of a core extending into an extension from a top of the gas spring is closed, an actuating path is formed.

12. The furniture item according to claim 11, wherein the second portion is sealed relative to an inner wall of the cylinder by a first sealing ring, the extension is sealed relative to the core by a second sealing ring, and the first portion is sealed relative to the inner wall of the guide pipe by a third sealing ring.

13. The furniture item according to claim 1, wherein the sensor is a photosensor.

14. The furniture item according to claim 1, wherein the sensor is an ultrasonic sensor.

15. The furniture item according to claim 1, wherein the sensor is an inductive sensor.

16. The furniture item according to claim 1, wherein the sensor is a capacitive sensor.

17. The furniture item according to claim 1, wherein the sensor is a Hall sensor.

18. The furniture item according to claim 1, wherein the switch is a reed contact.

19. The furniture item according to claim 1, wherein the switch is a microswitch.

20. The furniture item according to claim 1, wherein the at least one of the sensor and the switch:

detects a determined distance between a vertically adjustable component and at least one of a first part of the vertical pipe and a structural component part associated with the structural component part that is not vertically adjustable; and the at least one of the sensor and the switch is configured to send a signal to a control unit when the vertically adjustable component is moved in direction of the first part of the vertical pipe, wherein the control unit is configured to break a coil circuit so that an armature with a closing member closes the valve connection between the first work chamber and the second work chamber, even when a user actuates the actuating device.

* * * * *